US009362673B1

(12) United States Patent
Rinker

(10) Patent No.: US 9,362,673 B1
(45) Date of Patent: Jun. 7, 2016

(54) SECURE CONNECTOR WITH SPRING RELEASE

(71) Applicant: Charles Rinker, Wake Forest, NC (US)

(72) Inventor: Charles Rinker, Wake Forest, NC (US)

( * ) Notice: Subject to any disclaimer, the term of this patent is extended or adjusted under 35 U.S.C. 154(b) by 0 days.

(21) Appl. No.: 14/714,497

(22) Filed: May 18, 2015

(51) Int. Cl.
*H01R 4/50* (2006.01)
*H01R 13/639* (2006.01)
*H01R 31/06* (2006.01)

(52) U.S. Cl.
CPC ..... *H01R 13/639* (2013.01); *H01R 31/06* (2013.01)

(58) Field of Classification Search
CPC .. H01R 13/639; H01R 31/06; H01R 31/6581; H01R 13/5045; H01R 13/6392
USPC ..... 436/345
See application file for complete search history.

(56) References Cited

U.S. PATENT DOCUMENTS

2012/0009811 A1* 1/2012 He ..... H01R 13/6581 439/345
2014/0187075 A1* 7/2014 Tanaka ..... H01R 13/639 439/345
2014/0227897 A1* 8/2014 Chang ..... H01R 13/6392 439/345

* cited by examiner

*Primary Examiner* — Jean F Duverne
(74) *Attorney, Agent, or Firm* — John L Sotomayor

(57) ABSTRACT

This document presents an adaptor that has both male and female USB type connectors. The adaptor has an activation button held in tension by an internal spring and locking prongs that are moved in response to depressing and releasing the activation button. The locking prongs retract into a cutout depression in the insulating portion of the male connector and into the open space of the female portion of the adaptor. The adaptor locks both male and female USB connectors attached to cables or devices so as to secure the electrical and physical connection of these cables and devices during relocation or transport of the equipment containing the USB connectors. A single adaptor may be used to securely connect two cables together, a cable to a device, or two devices during movement or transport.

8 Claims, 8 Drawing Sheets

SECURE CONNECTOR WITH SPRING RELEASE

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

The present invention relates generally to connectors and connector adaptors requiring a secure physical and electrical connection to be established and maintained during transport of devices containing one or more of the connectors. Many connectors take advantage of secure and locked connections with connectors built into cables or devices. Connectors attached to devices or cables that do not have a portion of the device dedicated to maintaining a locked status when the connectors are joined to the cable or device may become disconnected when the device or apparatus containing the connector is shipped or otherwise travels to a destination different from where the connector and the device or cable were joined together.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
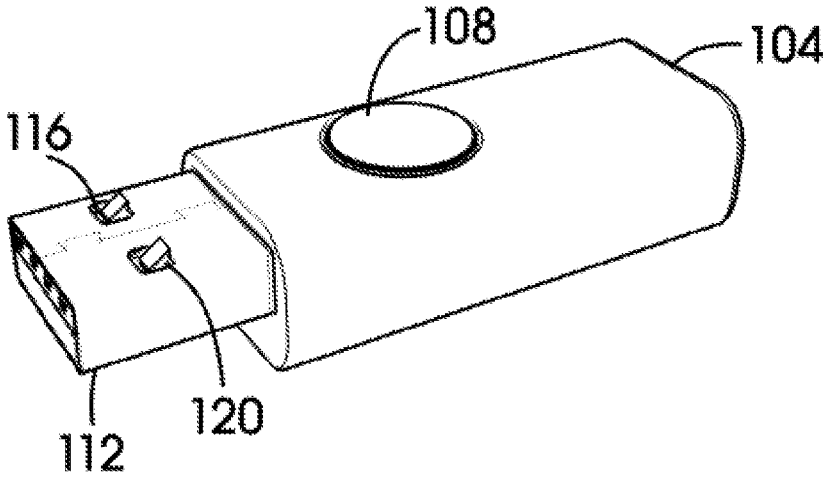
FIG. 1 is a view of the male portion of a secure locking connector adaptor consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

Reference throughout this document to USB refers to a Universal Serial Bus, and is more particularly related to a Universal Serial Bus port or connection point.

Reference throughout this document to HDMI refers to the High Definition Multimedia Interface standard, and is more particularly related to a High Definition Multimedia Interface port or connection point.

Turning now to FIG. 1, is a view of the male portion of a secure locking connector adaptor consistent with certain embodiments of the invention. In this view of the secure locking connector adaptor 100 the adaptor is composed of a shell 104 that may be a flattened cylinder, cylindrical, a rectangular tube, or any other shape of enclosure that permits the installation within the shell 104 of the adaptor 100 components. One surface of the adaptor shell 104 may have a button 108 that extends through a cutout in the adaptor shell 104 that permits the activation button 108 to extend through the adaptor shell 104 wall when the activation button 108 is depressed by a user. The activation button 108 is positioned substantially in the center of the longitudinal dimension of the adaptor shell 104. At one end of the adaptor shell 104 a typical male connector portion 112 for USB and HDMI types of connectors extends outward from the end of the adaptor shell 104 in such a manner so as to permit the insertion of the male connector portion 112 into a standard USB or HDMI female connection point on a cable or device having a USB or HDMI port. The male connector portion 112 is of the same dimension and size so as to permit both physical and electrical connection with a standard female USB port or connector. The male connector portion 112 additionally comprises two openings 116 through the flat surfaces of the male connector portion 112 consistent with a standard configuration of a USB or HDMI male connector. The adaptor 100 additionally comprises two projections that extend from inside the male connector portion 112, through the upper surface of the male connector portion 112 to form two prongs 120 adapted to serve as locking prongs. The locking prongs 120 extend into matching openings in the female connector portion of a standard USB or HDMI port or connector to lock the adaptor male portion 112 into place and prevent the adaptor 100 from disconnecting from the USB or HDMI port or connector until the locking prongs 120 are depressed, moving down into the body of the male portion 112 of the adaptor 100 and permitting the adaptor to be removed from a USB or HDMI port or connector into which the adaptor 100 may have been attached and locked in place.

The male connection portion 112 forms one half of the secure locking adaptor 100 for USB and HDMI ports and connectors.

Figure 2:
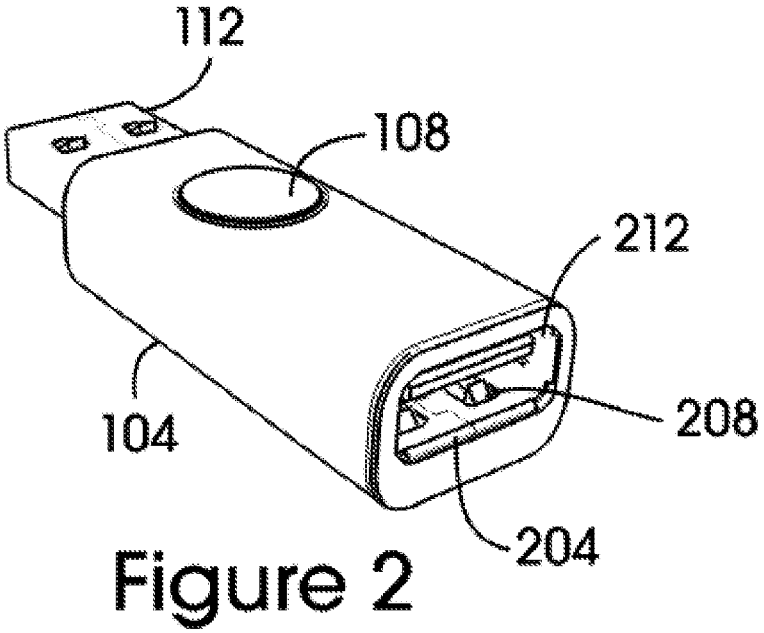
FIG. 2 is a view of the female portion of a secure locking connector adaptor consistent with certain embodiments of the present invention.

Turning now to FIG. 2, this figure presents a view of the female portion of a secure locking connector adaptor consistent with certain embodiments of the present invention. One surface of the adaptor shell 104 may have an activation button 108 that extends through a cutout in the adaptor shell 104 that permits the activation button 108 to extend through the adaptor shell 104 wall when the activation button 108 is depressed by a user. The activation button 108 is positioned substantially in the center of the longitudinal dimension of the adaptor shell 104. At an end of the adaptor 100 opposite to the end of the adaptor shell 104 from which a male connector portion 112 extends is a female connector portion 204 that extends into the body of the adaptor shell 104. The female connector portion 204 contains two locking prongs 208 that extend from the interior of the adaptor shell 104, through openings in the sidewall 212 of the female connector portion 204, and extend into the body of the female connector portion 204. The locking prongs 208 are positioned such that upon insertion of a male portion of a USB cable or device into the female connector portion 204 of the adaptor 100, the locking prongs 208 will engage two standard openings in the body of the inserted male USB connector and lock the male USB connector into the female connector portion 204 of the adaptor.

In an alternative embodiment, the adaptor 100 may be configured for the insertion of a male HDMI connector portion into the female connector portion 204 when adapted to support an HDMI connector, rather than a USB connector.

Figure 3:
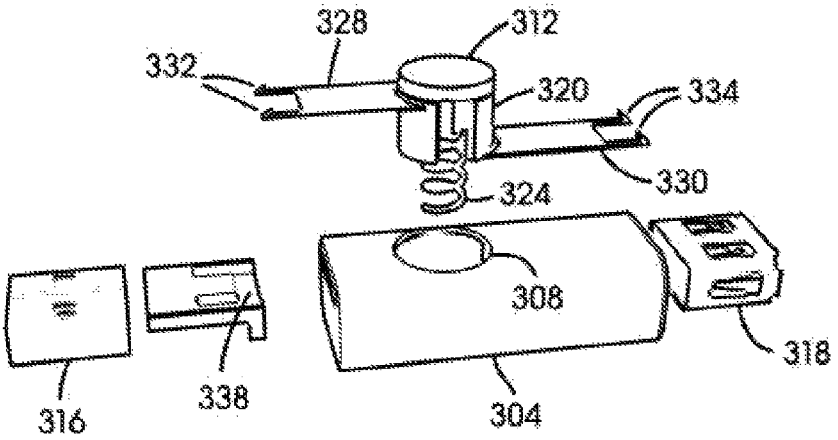
FIG. 3 is an exploded view of the components that comprise the secure locking connector adaptor consistent with certain embodiments of the present invention.

Turning now to FIG. 3, is an exploded view of the components that comprise the secure locking connector adaptor consistent with certain embodiments of the present invention. The adaptor 300 is presented in an exploded view to present the components of the adaptor 300 contained within the adaptor shell 304. In an exemplary embodiment, the adaptor shell 304 may be a flattened cylinder, cylindrical, a rectangular tube, or any other shape of enclosure that permits the installation within the shell 304 of the adaptor 300 components. By way of example and not of limitation, the figure presents an adaptor shell 304 that is a rounded rectangle in cross-section. The rounded rectangle adaptor shell 304 may have one side into which a circular opening 308 is cut through the side of the adaptor shell 304. The circular opening 308 is of sufficient size to permit the installation of an activation button 312 that may be depressed by a user. The circular opening 308 may be positioned off-center, such that it is closer to a male connector portion 316 of the adaptor 300 than to a female connector portion 318 of the adaptor 300. However, this should in no way be considered as limiting as the design choice for positioning of the circular opening 308 could permit the circular opening 308 to be positioned at any point along the adaptor shell 304 without changing the function of the adaptor 300. Additionally, the circular opening could, in additional exemplary embodiments, be a square, oval, triangular, or any other shape opening so as to accommodate the desired shape of the activation button 312 to be installed within the opening 308.

The activation button 312 that extends through the circular opening 308 is an activation portion of the adaptor 300. The activation button 312 forms the top of a body 320 having a hollow center into which a locking spring 324 is installed. Additionally, extending along the longitudinal direction of the adaptor shell 304 are an upper tab 328 and a lower tab 330. The upper tab 328 has an elongated body of sufficient length to extend from the activation button body 320 through the end of the adaptor shell 304 and into the male connector portion 316 of the adaptor, and is physically connected to the activation button body 320 at a point such that when the activation button 312 extends into the circular opening 308, the upper tab 328 is immediately adjacent to the upper inside surface of the adaptor shell 304. The upper tab 328 terminates in two upper locking prongs 332 that form the locking portion of the male connector portion 316 when the adaptor is in use. The lower tab 330 has an elongated body of sufficient length to extend from the activation button body 320 through the body of the adaptor shell 304 and into the female connector portion 318 of the adaptor, and is physically connected to the activation button body 320 at a point such that when the activation button 312 is depressed down below the circular opening 308, the lower tab 330 is immediately adjacent to the lower inside surface of the adaptor shell 304. The lower tab 330 terminates in two lower locking prongs 334 that form the locking portion of the female connector portion 318 when the adaptor is in use.

The locking spring 324 is installed within the hollow central portion of the activation button 312. The locking spring 324 is positioned such that it is in tension when the activation button 312 is depressed. When depressed by action of a user, such as putting pressure on the activation button 312, the activation button 312 will move from a position within the circular opening 308 to a position substantially within the body of the adaptor shell 304. The locking spring will act to move the activation button 312 from the interior of the adaptor shell 304 back into the circular opening 308 when the action of a user is released and there is no pressure on the activation button 312, positioning the activation button 312 for successive operations.

In an exemplary embodiment, when the activation button 312 is depressed, the spring 324 is compressed and the upper tab 328 and lower tab 330 simultaneously move vertically downward in association with the activation button body 320. The vertical motion is sufficient to insert the upper tab 328 into a cutout portion 338 of the male connector 316 portion of the adaptor 300. When the upper tab 328 is positioned fully within the cutout portion 338, the upper locking prongs 332 are fully retracted into the cutout portion 338 and the male portion 316 of the adaptor 300 is no longer locked and may be removed from the cable or device into which it was inserted.

In this exemplary embodiment, when the activation button 312 is depressed, the lower tab 330 moves a sufficient vertical distance so as to disengage the lower locking prongs 334 from a male connector portion from a cable or other device that has been inserted into the female portion 318 of the adaptor 300. In this manner, when a user depresses the activation button 312 both the upper locking prongs 332 and lower locking prongs 334 are simultaneously disengaged from the locking action with any associated cable or other device and permit the adaptor 300 to be fully removed from structural and electrical connection with any cable or other device. Alternatively, while the activation button 312 remains undepressed by the action of a user, the spring 324 is active to keep the activation button 312 fully at the top of its vertical travel and engaging the upper locking prongs 332 with a female connector of a cable or other device and engaging the lower locking prongs 334 with a male connector of a cable or other device that has been inserted into the female portion 318 of the adaptor 300. In this manner, the adaptor 300 provides a structural and electrical connection that remains securely in place against the rigors of transporting connected devices.

Figure 4:
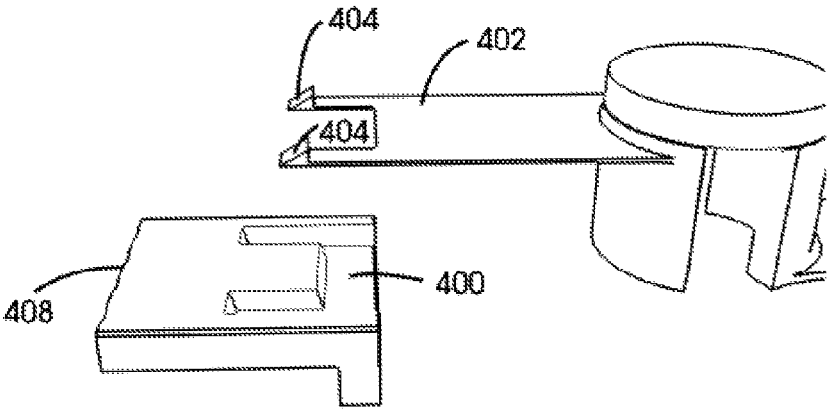
FIG. 4 is an exploded view of the components that comprise the male secure locking assembly consistent with certain embodiments of the present invention.

Turning now to FIG. 4, this figure presents an exploded view of the components that comprise the male secure locking assembly consistent with certain embodiments of the present invention. In this exemplary embodiment, a tab cutout 400 of sufficient dimension, depth and configuration to permit the full insertion of an upper tab 402 with attached upper locking prongs 404 within the tab cutout 400 is machined into an insulation portion 408 of a standard USB or HDMI connector. The upper tab 402 is positioned within the tab cutout 400 and the tab cutout 400 and insulation portion 408 assemblies are then inserted within the male connector portion of the adaptor. When assembled, the upper locking prongs 404 extend vertically through the upper surface of the male connector portion forming an ability to lock the male connector portion of the adaptor to a female connector portion of a cable or other device.

Figure 5:
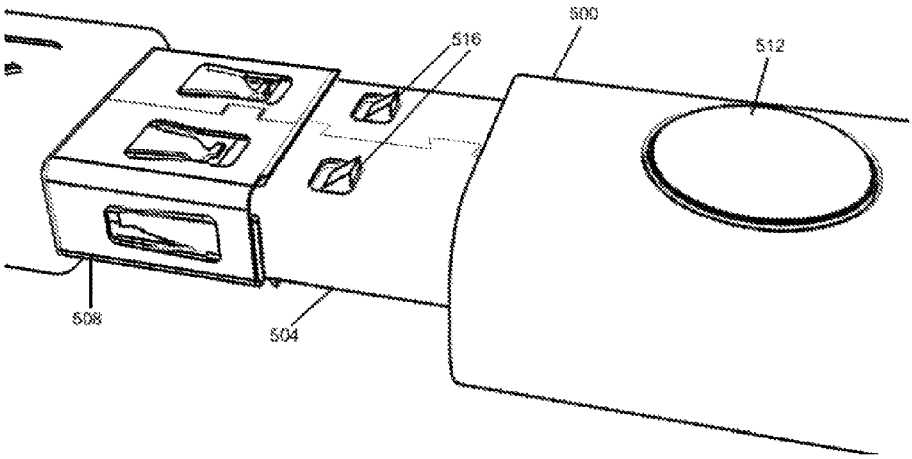
FIG. 5 is a connection view of the male connector section of the secure locking connector adaptor consistent with certain embodiments of the present invention.

Turning now to FIG. 5, is a connection view of the male connector section of the secure locking connector adaptor consistent with certain embodiments of the present invention. In an exemplary embodiment, the locking connector adaptor 500 is positioned to insert the male connector section 504 into the female connector portion 508 of a USB cable or the female connector portion of a USB capable device. Prior to the insertion of the male connector section 504 into the female connector portion 508, the activation button 512 is in a position that fully extends through the outer shell of the adaptor 500 and remains in a full upright position. The locking prongs 516 extend fully through two holes that are standard cutouts in the male connector section 504 of a cable or other USB device.

Figure 6:
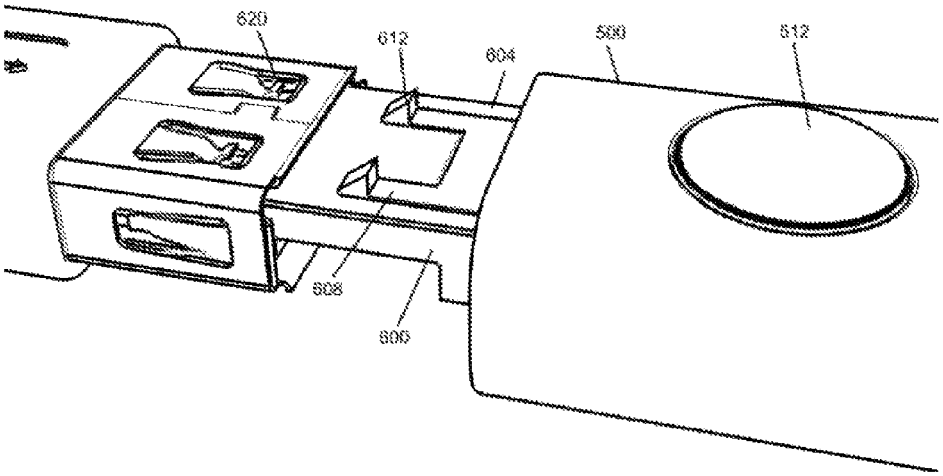
FIG. 6 is a cutaway view of male connector section of the secure locking connector adaptor consistent with certain embodiments of the present invention.

Turning now to FIG. 6, is a cutaway view of male connector section of the secure locking connector adaptor consistent with certain embodiments of the present invention. In an exemplary embodiment, this view presents the internal structure of the male connector section of the adaptor 500. Within the outer shell of the male connector portion (not shown), a standard insulator portion 600 has a cutout section 604 into which the upper tab 608 body and the associated locking prongs 612 fit. The cutout section 604 is of sufficient vertical dimension to permit the upper tab 608 to nest fully within the cutout section 604 when the activation button 512 is depressed by a user. When the activation button 512 is fully depressed by a user, the upper tab 608 moves vertically a sufficient amount to depress the locking prongs 612 so as to disengage the locking from the two holes that are standard cutouts in the male connector section of a cable or other USB device. In this exemplary embodiment, the locking prongs 612 are tapered vertically, with the slope from the base back toward the body of the adaptor 500.

Figure 7:
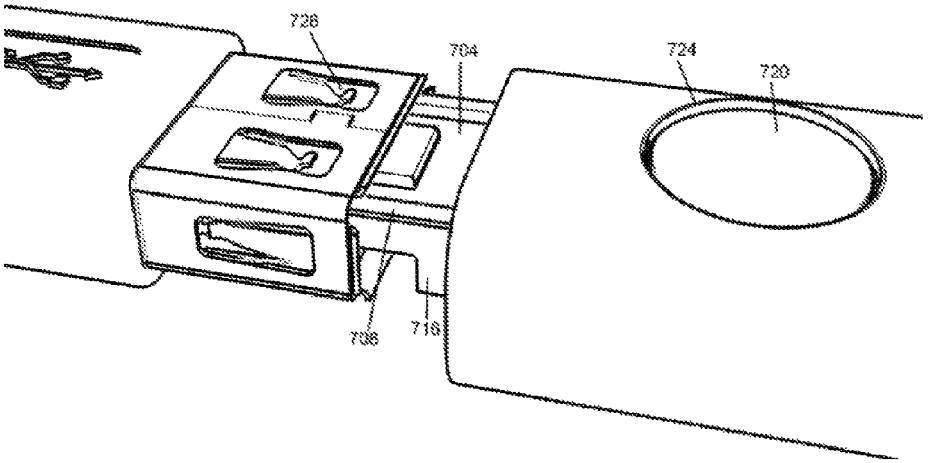
FIG. 7 is a view of the insertion of the male connector portion with a female connector of a cable or device consistent with certain embodiments of the present invention.

Turning now to FIG. 7, this figure is a view of the insertion of the male connector portion with a female connector of a cable or device consistent with certain embodiments of the present invention. In an exemplary embodiment, the locking prongs (not shown) as previously described are tapered so as to permit the upper tab 704 to move vertically down into a cutout section 708 of the insulator portion 716 when force is applied to the locking prongs (not shown). As a connector is paced into contact with the locking prongs (not shown) the force used to insert a connector from a cable or device into the adaptor will be a sufficient force to push the connector past the locking prongs (not shown), the taper of the locking prongs (not shown) sufficient to allow the connector to pass and come into complete contact with the adaptor by pressing the upper tab 704 vertically downward into the cutout section 708 of the insulator portion 716.

As the upper tab 704 moves vertically down into the cutout section 708, the activation button 720 is depressed the same vertical distance, moving down into the opening 724 cut into the adaptor body until the locking prongs (not shown) engage the two openings in the shell of a female USB connector 728.

Figure 8:
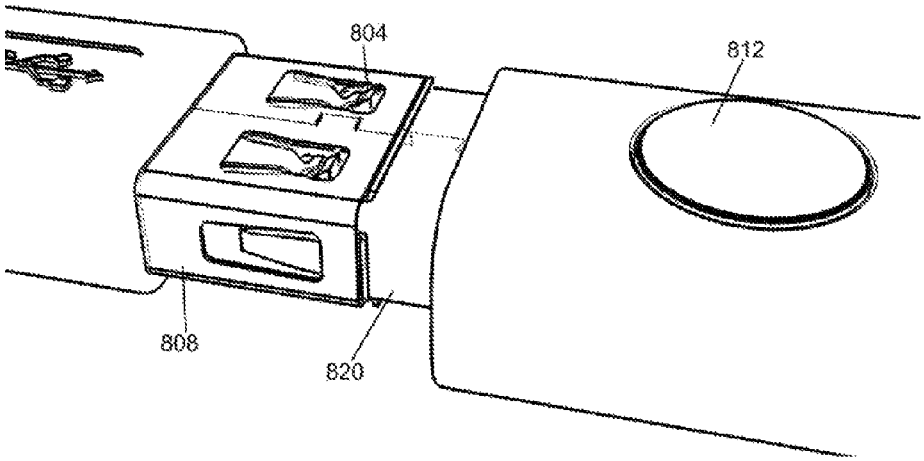
FIG. 8 is a view of the male locking portion of the adaptor fully engaged in locked position consistent with certain embodiments of the present invention.

Turning now to FIG. 8, this figure is a view of the male locking portion of the adaptor fully engaged in locked position consistent with certain embodiments of the present invention. In an exemplary embodiment, the locking prongs 804 have snapped into position within the two openings in the shell of the female USB connector 808. This positioning is forced by the spring (not shown) held in tension within the body of the activation button 812. The spring will maintain tension in a vertically upward direction, holding the locking prongs 804 in place within the two openings in the shell of the female USB connector until a user presses the activation button 812 with sufficient force to overcome the spring tension and move the upper tab portion (not visible) and the attached locking prongs 804 down vertically to permit the male portion of the adaptor to be withdrawn from the female connector of the USB connector 808, thus unlocking the adaptor from the USB connector 808.

Figure 9:
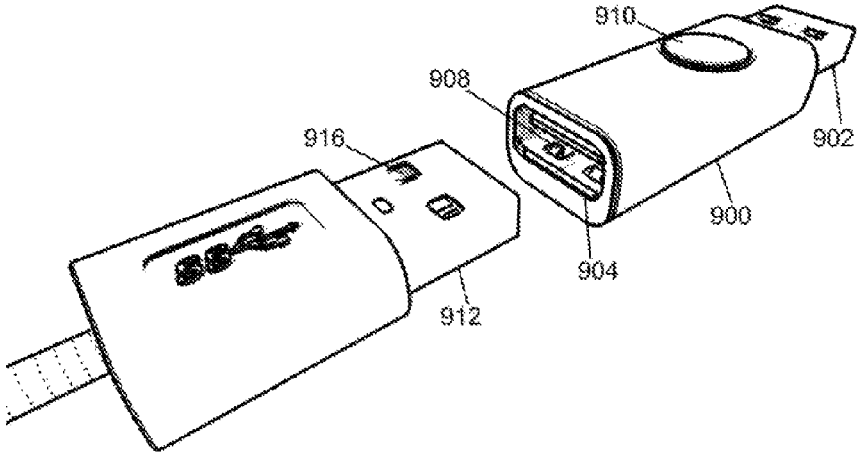
FIG. 9 is a view of the male portion of a connector being inserted into the female locking portion of the adaptor consistent with certain embodiments of the present invention.

Turning now to FIG. 9, this figure is a view of the male portion of a USB connector being inserted into the female locking portion of the adaptor consistent with certain embodiments of the present invention. In this exemplary embodiment, the adaptor 900 comprises both male 902 and female 904 locking connector portions. This figure presents a view of the internal structure of the female connector portion 904 of the adaptor 900. The lower tab and associated locking prongs 908 are positioned such that the taper of the locking prongs 908, in combination with the force provided by a user inserting the male portion of a USB connector associated with a cable or other USB device, translates the force used to insert the male portion of a USB connector into the adaptor into vertical movement of the lower locking tab. This action of connector insertion of the male portion of a USB connector provides the force to overcome the spring tension of the activation button 910 and move the lower tab and associated locking prongs 908 vertically downward, and, at the same time depress the activation button 910 against the spring (not shown). The downward motion of the locking prongs 908 is of a sufficient distance to move the locking prongs 908 out of the way of the shell of the male connector 912 and permit the male connector to be fully inserted into the female locking connector portion 904 of the adaptor 900. When the male connector 912 has traveled a sufficient distance into the body of the female locking connector portion 904, the open cutouts 916 in the shell of the male connector a positioned over the locking prongs 908. The spring (not shown) has maintained tension so as to provide the force to move the lower tab and locking prongs 908 vertically upward so as to position the locking prongs 908 into the open cutouts 916. Simultaneously, the activation button 910 will be moved vertically by the spring (not shown) back up through the cutout in the adaptor body 900 until the activation button 910 once again positioned flush with, or slightly above, the surface of the adaptor body 900. The male connector 912 is now fully inserted and locked into the female locking portion 904 of the adaptor 900.

Figure 10:
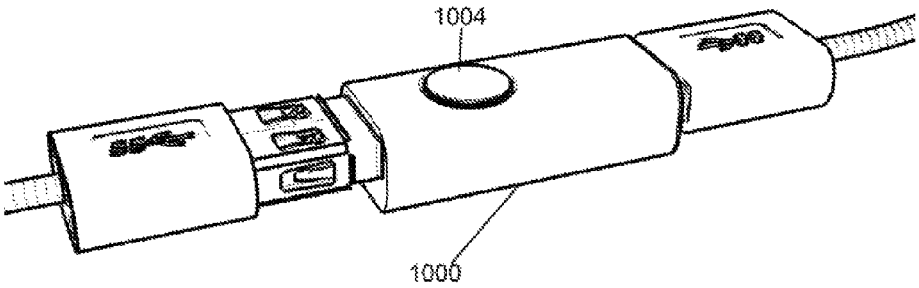
FIG. 10 is a view of the male portion and female connectors of a connector fully inserted and locked into the adaptor consistent with certain embodiments of the present invention.

Turning now to FIG. 10, this figure is a view of the male portion and female connectors of a USB connector fully inserted and locked into the adaptor consistent with certain embodiments of the present invention. In this exemplary embodiment the locking adaptor 1000 is capable of connecting a USB cable to another USB cable, a USB cable to a USB device, a USB device to a USB cable and locking each component securely together to form a structural and electrical connection that is strong enough to ensure the connection against the rigors of moving or transporting the connected cables and devices. Additionally, the adaptor is easily disconnected from any cable or device when a user is ready by simply depressing the activation button 1004 to depress the locking pegs in both the male and female portions of the adaptor 1000 to break the lock and permit the adaptor 1000 to be disengaged from any device or cable previously locked together with the adaptor 1000.

In an additional exemplary embodiment, the adaptor 1000 may be constructed so as to provide the same locking features and capabilities for an HDMI connector, or for any other connector for which the insulator portion may be cutout so as to provide a depression for the insertion of a tab and associated locking prongs. The insulator cutout is of sufficient depth to fully contain the tab and locking prongs when the adaptor is in use. The vertical motion of a tab and associated locking prongs is accomplished through the depression of the activation button or the insertion of a male or female connector portion so as to lock and unlock the male and female connector portions of the adaptor.

In an additional embodiment, the adaptor may be configured with an additional locking structure. The locking structure may be present to retain the activation button in a locked position until the locking structure is operated so as to provide access to the activation button and permit the activation button to be released from the locked position. In an embodiment, the locking structure may consist of a "push lock" mounted into the top of the activation button. The 'shaft' of the locking structure may be in a locked position of sufficient length to keep the activation button from being depressed. Upon unlocking the push lock, the shaft would release allowing the activation button to be in an unlocked state and permitting the activation button to be depressed and disengage the male and female connector portions of the adaptor from the cable or device connectors joined by the male and female connector portions of the adaptor.

In an additional embodiment, the locking structure may be constructed as a portion of the activation button central shaft. In this embodiment, the activation button may be constructed with a smaller diameter than the opening in the body of the adaptor. The open area between the outside edge of the activation button and the inside edge of the opening in the body of the adaptor is of sufficient size to accommodate a tubular key. The shaft of the activation button may have a flange or other structure that is engaged when the activation button is depressed such that the flange holds the activation button in a locked position such that it may not be depressed so as to disengage the male and female connector portions of the adaptor. The tubular key has a tab on the exterior of the tubular key that is configured to come into contact with the flange within the shaft of the activation button as the key is inserted into the space between the activation button and the opening in the body of the adaptor. When the key is inserted and turned, it is operative to move the flange to an unlocked position, which is a position in which the flange no longer interferes with the operation of the activation button. The tubular key may then be removed from the locking structure, having placed the activation button in an unlocked position and the activation button may then be freely depressed to disengage the male and female connector portions of the adaptor.

While certain illustrative embodiments have been described, it is evident that many alternatives, modifications, permutations and variations will become apparent to those skilled in the art in light of the foregoing description.

What is claimed is:

1. An adaptor assembly, comprising:

a hollow shell forming an outer body of the adaptor assembly;

a female type connector inset into a first portion of the outer body and a male type connector extending from a second portion of the outer body;

an opening in a surface of the outer body sufficient to permit an activation button to be inset in the opening, and permitting the activation button to be depressed in a downward vertical motion;

a first tab connected to the activation button at a proximal end and a second tab connected to the activation button at a proximal end, the first tab extending into the male type connector and the second tab extending into the female type connector when the first tab and the second tab are installed within the outer body;

the first tab and the second tab adapted to move vertically in the same direction as the activation button;

the first tab configured to move vertically down into a cutout section of an insulator portion of a male type connector and the second tab configured to move vertically down into an open area of a female type connector when the activation button is pressed downward.

2. The adaptor assembly of claim 1, where the hollow shell of the outer body of the adaptor assembly is configured such that the first tab, the second tab, and the activation button are installed within the hollow shell.

3. The adaptor assembly of claim 1, where the activation button comprises a hollow shaft extending from the activation button into the outer body of the adaptor and a spring inset into the hollow shaft and configured to place tension on the activation button so as to maintain the position of the activation button within the opening in the outer body of the adaptor.

4. The adaptor assembly of claim 1, the first tab and the second tab each having locking prongs configured at the distal end of the first tab and the second tab.

5. The adaptor assembly of claim 4, where the locking prongs are positioned to permit the locking prongs of the first tab and the second tab to extend into openings in a surface of the casing of a male type connector.

6. The adaptor assembly of claim 5, where the locking prongs prevent the removal of a female connector of the adaptor assembly and the removal of a male connector of the adaptor assembly from the male connector and female connector of a cable or device connected together by the adaptor assembly.

7. The adaptor assembly of claim 1, where the male connector portion and female connector portion of the adaptor assembly are configured to connect to a USB female connector and a USB male connector respectively.

8. The adaptor assembly of claim 5, where the cutout section of an insulator portion of the male connector is of a configuration and vertically depth to accept the first tab and disengage the locking prongs when the activation button is depressed and the first tab is fully inserted within the cutout section.

* * * * *